US005404954A

United States Patent [19]

Whitebay et al.

[11] Patent Number: 5,404,954

[45] Date of Patent: Apr. 11, 1995

[54] WELL SCREEN FOR INCREASED PRODUCTION

[75] Inventors: Lee E. Whitebay; Nobuo Morita, both of Ponca City, Okla.

[73] Assignee: Conoco Inc., Ponca City, Okla.

[21] Appl. No.: 61,867

[22] Filed: May 14, 1993

[51] Int. Cl.[6] ..... E21B 43/08

[52] U.S. Cl. ..... 166/369; 166/230; 210/499

[58] Field of Search ..... 166/230, 369; 210/499, 210/747

[56] References Cited

U.S. PATENT DOCUMENTS

| | | | |
|---|---|---|---|
| 321,550 | 7/1885 | Vosburgh | 166/230 |
| 801,995 | 10/1905 | Kisner | 166/230 |
| 1,342,986 | 6/1920 | Cater | 166/230 |
| 2,035,313 | 3/1936 | Griffin | 166/230 X |
| 2,100,145 | 11/1937 | Moore | 166/230 X |
| 2,257,344 | 9/1941 | Maloney | 166/236 X |
| 2,877,852 | 3/1959 | Bashara | 166/236 |
| 3,057,481 | 10/1962 | Pall | 210/499 X |
| 3,133,595 | 5/1964 | Loughney et al. | 166/228 |
| 3,591,010 | 7/1971 | Pall et al. | 210/499 X |
| 3,768,557 | 10/1973 | Spurlock et al. | 166/228 |
| 4,064,938 | 12/1977 | Fast | 166/236 |
| 4,434,054 | 2/1984 | Livesey et al. | 210/484 |
| 4,487,259 | 12/1984 | McMichael, Jr. | 166/228 |
| 4,649,996 | 3/1987 | Kojicic | 166/228 |
| 4,696,751 | 9/1987 | Eifling | 210/499 X |
| 4,811,790 | 3/1989 | Jennings, Jr. | 166/278 |
| 4,821,800 | 4/1989 | Scott et al. | 166/228 |
| 4,858,691 | 8/1989 | Ilfrey et al. | 166/230 X |
| 4,917,183 | 4/1990 | Gaidry et al. | 166/278 |
| 4,969,518 | 11/1990 | Schmitt | 166/228 |
| 5,232,048 | 8/1993 | Whitebay et al. | 166/228 |

FOREIGN PATENT DOCUMENTS

| | | | |
|---|---|---|---|
| 2132106A | 12/1983 | United Kingdom . | |
| 2223523A | 9/1989 | United Kingdom . | |
| 1530702 | 12/1989 | U.S.S.R. | 166/230 |

OTHER PUBLICATIONS

Advertisement from Purolator Products Co.

*Primary Examiner*—Hoang C. Dang
*Attorney, Agent, or Firm*—William D. Hall

[57] ABSTRACT

The present invention provides a well filter assembly for incorporation in a production system which will initially allow passage of particles which will only minimally damage the interior of the production system. After a period of time, the filter assembly will preclude passage of all damaging particles while allowing passage of those particles which will not deteriorate or obstruct the production system. Additionally, the well screen assembly is designed to mechanically break down the filter cake which was formed during drilling of the well in order to preclude plugging of the filter. Further, the filter of the prepacked well screen assembly is of sufficient strength so as to maintain its filtering capacity even after damage due to deformation. Finally, a method is provided for utilizing the well filter assembly in a production system.

4 Claims, 1 Drawing Sheet

WELL SCREEN FOR INCREASED PRODUCTION

BACKGROUND OF THE INVENTION

1. Summary of the Invention

This invention relates to a method and apparatus for selectively screening particulate matter from produced fluids. More particularly, a well screen is arranged to pass particulate matter of a predetermined size which will not substantially erode or block equipment in the flow path of the produced fluids. Further, the invention relates to a well screen which will increase the production of fluids from a well.

Commonly, a drilling mud is used when drilling a well into an earth formation for the production of fluids. When drilling a hydrocarbon well the drilling mud acts as both a lubricant and a borehole stabilizer. Typical drilling muds are comprised of water, polymers, starch, barite, bentonite and additional additives which may be chosen depending upon the environment of the well.

While the drilling mud serves a useful purpose in the drilling of a borehole, the presence of the mud during the production of fluids may be detrimental. Typical drilling muds will form a filter cake on the walls of the borehole. This cake consists of small particles some of which were originally a part of the mud. Depending on the drilling mud used and the characteristics of the formation, these particles are usually 100 microns or smaller. Due to the high pressures incurred during drilling this cake is very dense and compact and is capable of precluding the flow of fluids. Therefore, it is desirable to remove the cake prior to producing fluids from the well. However, due to the nature of the cake it is not easily removed and will commonly plug filters placed in the well production system. As a result several workover trips may be required to replace or clean the filters. These procedures delay production of fluids and increase costs as the expense of replacing a filter in an offshore oil well may be several million dollars not including the revenue lost by the delay in production.

2. Background of the Invention

Prior to the present invention, the preferred method of producing fluid from wells has been to remove all or substantially all solid particles from the fluid before it entered the production pipe. Over the years several different methods and filters have been introduced. Some of these methods include gravel packing the well, use of prepacked filters which may utilize sand, gravel or another media, or use of fibrous materials. In each instance, the primary goal has been to preclude passage of solid particles through the production pipe string. The following provides a brief summary of apparatus used to achieve this goal.

U.S. Pat. No. 3,768,557 describes a graded multi-layer pre-packed sand filter for oil and other fluids containing sand. At col. 1, line 15, the stated purpose of the filter is to remove the sand from the liquid before it is produced from the well bore.

U.S. Pat. No. 4,34,054 describes a filter which is capable of segregating out the solid component of a fluid flow. The filter comprises a bed of randomly disposed fibrous members which retain solid particles and allow the particle free fluid to pass.

U.S. Pat. No. 4,917,183 describes a pre-packed gravel packing screen. The screen has a filtering bed comprising a fluid permeable bed of particulate solids. The particulate solids are sized to effectively prevent all the particulate matter in the well production fluids from passing inwardly through the bed into the well conduit.

While in the past it was believed that all solid particles must be excluded from the produced fluids, the present invention provides a method and apparatus which allows for the economical production of fluids containing particulate matter. Due to the high cost of replacing a well filter, production of fluids containing particles of sand and other material is desired if the procedure is not detrimental to the production system.

One reason for filtering solids from the produced fluids is that ultimately such solids must be removed from the product that is passed to a sales line. This is usually accomplished by various separation techniques such as gravity vessels, centrifuges, hydrocyclones, etc. While these processes are costly and the equipment requires valuable space, especially on an offshore platform, these expenses are quickly exceeded by the costs of the workover procedures which must be performed to replace or remediate plugged filters.

Thus, one object of the present invention is to provide a filter assembly which selectively allows for the initial production of fluids containing particulate matter. The particles to be produced have been predetermined to only minimally damage the interior of the production system. Further, following this initial period, the filter of the present invention will specifically allow the production of those particles which will not damage, obstruct or erode the interior of the production system while precluding the production of potentially damaging particles. The present invention also includes a method for filtering particles from produced fluids. According to this method, various apparatus may accomplish the filtering scheme of this invention, i.e. to pass those solids which will not damage equipment during production of fluids from the well.

BRIEF DISCLOSURE OF THE INVENTION

In general, the present invention provides a well filter assembly for selectively filtering particles from the produced fluids of a well. The filter assembly comprises a perforated or slotted pipe adapted to engage a production pipe string. The perforated or slotted pipe carries a series of wire screen mesh arranged around the pipe as a filtering media. The wire screen mesh is sequenced such that larger particles are removed by the outer screen while smaller particles are removed by the inner screens. If desired the wire screen mesh may be fluted or formed in a tight accordion shape so as to provide increased filtering surface area and increased strength.

In accordance with the objects of the present invention, the wire screen mesh is arranged in a manner to selectively permit the initial production of particles of a predetermined size with the produced fluids. The size of particles to be produced having been calculated to only minimally damage the interior of the production system. Following this initial period, the wire screen mesh will retain a sufficient number of larger particles such that the filter is now capable of removing all damaging particles from the produced fluid due to the build up of particles on the exterior screens. At this time the filter will selectively allow production of particles which will not cause erosion while removing substantially all particles which may cause erosion or blockage of the production system.

Additionally, the present invention provides a well filter assembly capable of mechanically breaking down the filter cake formed during construction of the borehole. Build up of a filter cake on a downhole filter reduces production rates and may plug conventional filters. The wire screen mesh of the well filter assembly of the present invention obviates these problems. The wire screen mesh achieves this advantage when the filter cake is forced against the screen under the high hydraulic pressures incurred during the production of fluids from the well. The combination of the hydraulic pressure against the wire mesh operates to break up the filter cake into the smaller individual particles comprising the cake. Preferably the series of wire screen mesh has been chosen to allow the production of substantially all of the particles of the filter cake with the produced fluids.

The present invention further provides a well filter assembly for use in cased and uncased boreholes which resists deformation and maintains its filtering capacity in the event of damage or deformation. As previously noted, the present invention utilizes a series of wire screen mesh as a filter media. In one embodiment, the filter media may be formed by simply wrapping the wire screen mesh in layers around the perforated pipe. However, the present invention additionally provides a series of wire screen mesh which has been formed into an accordion type structure prior to being placed on the perforated pipe as the filter media. The pleats of the accordion shape impart increased structural rigidity to the filter media and due to the tightness of the pleats the media maintains its filtering capacity even if it is deformed by downhole pressures.

The present invention further provides a method for selectively filtering particulate matter from fluids being produced from earth formations by means of a production system. The method comprises the steps of placing a slotted or perforated pipe section into a string of production pipe. The slotted or perforated pipe section carries a filtering media arranged around the pipe. The preferred filtering media will allow those particles which have been calculated to only minimally damage the interior of the production system to pass through the media and be produced with the produced fluids. Further, the filter media may be arranged to provide a means of retaining a sufficient number of larger particles due to a build up of particles on the surface of the filter media. Thus, after a period of time all potentially damaging particles are removed from the fluid stream. However, the filter media will preferentially allow production of those particles which have been calculated not to cause damage to the interior of the production system.

The present invention further provides a method for mechanically breaking down a filter cake which was formed during construction of the borehole. According to this method substantially all of the particles of the filter cake are produced with the produced fluids.

Finally, the present invention provides a method for filtering particles from a stream of produced fluids wherein the method of filtering is not compromised by damage to or deformation of the filter assembly.

THE DRAWINGS

DESCRIPTION OF THE PREFERRED EMBODIMENTS

Figure 1:
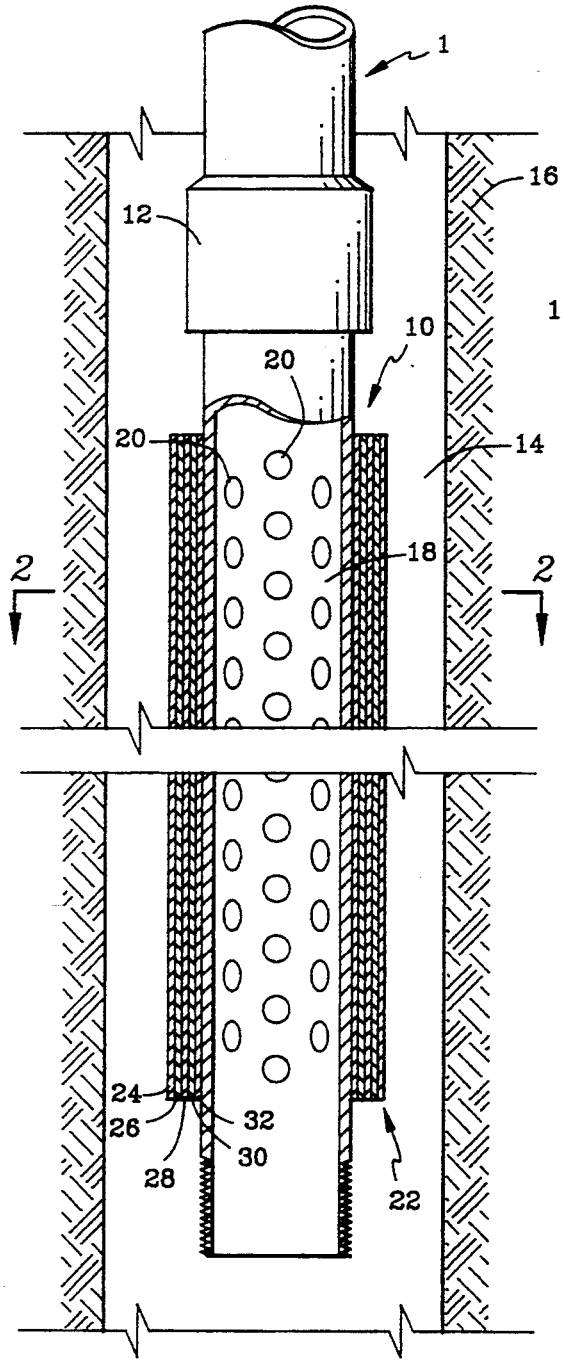
FIG. 1 is a side elevational view, partially cut away, showing a portion of a production system including a well filter assembly in accordance with the invention.

FIG. 1 depicts a portion of a well production system 1 having a well filter assembly 10 attached to the end of a production pipe string 12 which extends into a borehole 14 adjacent a producing zone 16. FIG. 1 depicts an uncased vertical well, but well filter assembly 10 is equally useful in cased vertical wells and in cased or uncased deviated or horizontal wells.

Well filter assembly 10 comprises an inner perforated or slotted pipe section 18 having a series of openings 20 along its length. The size and shape of the openings are not critical so long as they provide a substantial area for flow of produced fluids and the structural integrity of the pipe is maintained.

Positioned about pipe section 18 is filter media 22. Filter media 22 consists of a series of wire screen mesh 24, 26, 28, 30 and 32. While the present invention will be described as having five meshes, it is contemplated that the actual number of meshes utilized may vary from well to well. The wire screen meshes utilized by the present invention may have mesh numbers ranging from about 10 to about 160 U.S. Standard Mesh. Preferably, the wire screen mesh is sequenced such that larger particles (not shown) carried by the produced fluids are removed by the outer screen while smaller particles (not shown) are removed by the inner screens.

Figure 2:
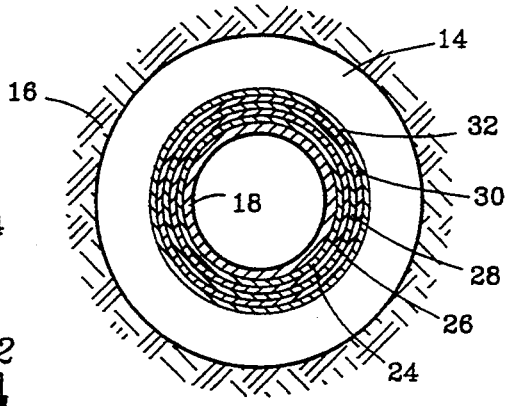
FIG. 2 is a cross sectional view taken along 2—2 of FIG. 1 illustrating the series of wire screen mesh in layers.

FIG. 2 shows one embodiment of the present invention wherein wire screen meshes 24, 26, 28, 30 and 32 are wrapped in layers around pipe section 18.

Figure 3:
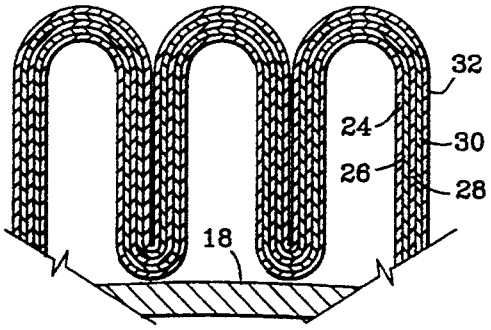
FIG. 3 is a partial cross sectional view illustrating the series of wire screen mesh in an accordion configuration.

FIG. 3 shows an alternate embodiment of the present invention in which wire screen meshes 24, 26, 28, 30 and 32 have been pleated or folded into a tight accordion shape prior to being wrapped around pipe section 18. In this embodiment, the pleats 34 are tightly compressed together in order to provide a filter assembly 10 having increased structural rigidity. This configuration additionally provides the well filter assembly 10 the ability to maintain filtration capacity even after deformation or damage of filter media 22 of assembly 10 by downhole forces or obstructions.

The configuration depicted in FIG. 3 is particularly useful in an uncased well. As noted above, pleats 34 provide a filter having increased structural rigidity and the ability to maintain filtering capacity even after deformation. These characteristics are advantageous in an uncased well where the filter is unprotected from the pressures of the formation. Further, pleats 34 provide for increased filtering capacity while maintaining a high flow rate for the produced fluids.

In either configuration, it is preferred to pick a series of wire screen mesh which will initially allow production of particles which have been calculated to produce only minimal erosion, damage or blockage within pipe string 12. By initially allowing production of those particles which cause only minimal erosion within pipe string 12, the flow rate of produced fluids to the surface is increased. The range of meshes preferred will vary from well to well depending upon the fluids to be produced, the rate of production, the geometry of the borehole, the type of the pipe string and the nature of the particles present in the formation. In general the mesh sizes will range from about 10 to 160 U.S. Standard Mesh.

As production of fluids continues, larger particles will begin to accumulate on exterior screen 32 while smaller particles will be removed from the fluids by interior screens 24, 26, 28 and 30. Preferably the screens will be sized such that following the initial production period all potentially damaging particles will be removed from the produced fluids while selectively allowing production of those particles which will not damage the interior of pipe string 12. Again, the size of those particles which may pass through filter media 22 without damaging production system 1 will vary from production system to production system.

Filter media 22 of well filter assembly 10 provides the additional advantage of mechanically breaking down any filter cake (not shown) which may have been formed during the drilling of the borehole. Typically, during the drilling of a borehole, drilling "mud" is used as a borehole stabilizer and a lubricant for the drill. This "mud" may be either oil or water based and commonly contains fine particulate matter. Under the high pressures of drilling this particulate matter is tightly packed into a cake along the walls of the borehole. Upon completion of the well, this cake must either be removed or broken down. Otherwise, upon initiation of production, the cake will be forced by the hydraulic pressure of the fluid in the formation against the pipe string and the filter. Under these conditions, the filter cake has the potential to plug conventional filters.

The present invention advantageously utilizes the hydraulic pressure created by the production of fluids from the well to break down the filter cake upon contact with wire screen mesh 24, 26, 28, 30 and 32. Due to the arrangement of the series of screens, the fluid forces will push the filter cake through the screens which in turn will shear the cake as it passes through the successively smaller openings. Additionally, the screens will advantageously permit fluid flow to initially bypass clumps of solids which have collected on the screens. The fluid flowing past these clumps will erode them from the edges, thereby enhancing the breakdown of the cake. After breakdown of the cake, substantially all of the particles will be produced with the produced fluids. In this manner, the present invention precludes plugging of the filter and economically increases production of fluids from the well.

As previously described, the present invention is designed to selectively filter particulate matter from fluids being produced into a cased or uncased borehole. Thus, the preferred manner of using well filter assembly 10 is to incorporate the well filter assembly into the pipe string of a well production system which is then lowered into the borehole. Preferably, the pipe string will be lowered to a position such that well filter assembly 10 will be adjacent to the fluid producing region of the well.

As previously noted, well filter assembly 10 comprises a slotted or perforated pipe which caries a series of wire screen mesh as the filter media. The series of wire screen mesh is arranged about the perforated pipe in a manner suitable to filter particulate matter from produced fluids. If desired, the series of wire screen mesh may be folded into an accordion configuration prior to being placed on the perforated or slotted pipe. This configuration provides the wire screen mesh with sufficient rigidity to allow it to maintain its filtering capacity despite any damage which may occur after it has been placed in the borehole. Preferably, the arrangement of the series of wire screen mesh provides for the removal of larger particles by the outermost screen filters and the removal of smaller particles by the inner screens.

In the method of using well filter assembly 10, the series of wire screen mesh is chosen in order to initially allow those particles which have been calculated to only minimally erode or damage the interior of the production system. The particle size which meets this requirement will vary from well to well and is dependent upon the geometry of the well, the type of fluids produced, the rate at which the fluids are produced and the nature of the particles present. Following the initial production period, the well filter assembly will then filter out substantially all potentially damaging particles and allow passage of only those particles which will not damage the interior of the production system.

While the present invention has been described with regards to FIGS. 1, 2 and 3, other embodiments will be apparent to those skilled in the art. For example, while this invention has been described as being particularly useful in uncased wells due to the economic advantages it provides, it is also possible to use this same technology in cased wells. Thus, it is intended that the specification be considered as only exemplary, with the true scope and spirit of the invention being indicated by the following claims.

We claim:

1. A method for screening particulate matter from fluids being produced into a wellbore from earth formations traversed by the wellbore wherein a pipe string is run into the wellbore to a position adjacent the fluid producing regions comprising the steps of:

placing a slotted or perforated pipe section in the string of production pipe, said pipe section carrying a series of wire screen mesh arranged around said pipe in a manner suitable for filtering particulate matter from the produced fluids;

arranging said series of wire screen mesh to mechanically breakdown any filter cake present in the wellbore when said filter cake is forced a 100 against said wire screen mesh by hydraulic pressure generated during the production of fluids followed by subsequent production of substantially all of the solid particles thereof which makeup said filter cake;

followed by allowing said wire screen mesh to pass particles which are calculated to only minimally erode the interior of said pipe screen while said series of wire screen mesh retains a sufficient number of particles in a manner to increase the filtering ability of said wire screen mesh such that after a period of time all particles which will cause erosion within said pipe string will be removed from the produced fluid.

2. The method of claim 1, and further including placing said filter assembly in an uncased borehole devoid of gravel pack between the filter assembly and the borehole.

3. The method of claim 1, wherein said series of screen mesh is arranged in a sequence such that the exterior meshes remove the larger particles from the fluid stream and the interior mesh removes the smaller particles from the fluid stream.

4. The method of claim 1, wherein said series of screen mesh is folded into an accordion configuration in order to provide increased rigidity thereby providing a means for filtering particles from the produce fluids even after damage of said filter assembly.

* * * * *

UNITED STATES PATENT AND TRADEMARK OFFICE

CERTIFICATE OF CORRECTION

ATENT NO.: 5,404,954

ATED: April 11, 1995

NVENTOR(S): Lee E. Whitebay and Nobuo Morita t is certified that error appears in the above-identified patent and that said Letters atent is hereby corrected as shown below:

n Claim 1, Column 6, line 39, the words "a 100" were inadvertently dded.

Signed and Sealed this

Twentieth Day of June, 1995

*Attest:*

*Attesting Officer*

BRUCE LEHMAN

*Commissioner of Patents and Trademarks*